US006887293B1

(12) United States Patent
Abad et al.

(10) Patent No.: US 6,887,293 B1
(45) Date of Patent: May 3, 2005

(54) METHOD OF MONITORING A FILTER SYSTEM FOR A PAINT SPRAY BOOTH

(75) Inventors: Glen Silva Abad, Placentia, CA (US); Ralph Edward Jaffke, Lakewood, CA (US); Jorge Arthur Millan, Lawndale, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/660,932

(22) Filed: Sep. 12, 2003

(51) Int. Cl.[7] ..... B05D 1/02

(52) U.S. Cl. ..... 55/385.2; 55/467; 55/DIG. 46; 95/19; 95/280; 454/187; 427/378; 427/379; 427/421

(58) Field of Search ..... 55/283, 467, 385.2, 55/DIG. 46; 95/19, 280; 454/187; 427/378, 379, 421

(56) References Cited

U.S. PATENT DOCUMENTS 4,951,600 A * 8/1990 Soshi et al. ..... 118/696
5,356,334 A 10/1994 Gray
5,505,763 A * 4/1996 Reighard et al. ..... 95/19
5,554,416 A 9/1996 Scheufler et al.
6,040,777 A 3/2000 Ammann et al.
6,168,646 B1 1/2001 Craig et al.
2002/0062788 A1 5/2002 Czech et al.

* cited by examiner

*Primary Examiner*—Minh-Chau T. Pham
(74) *Attorney, Agent, or Firm*—Louis L. Dachs

(57) ABSTRACT

The invention is a method of monitoring a filter for absorbing paint particles produced during spray painting with a spray gun in a paint spray booth coupled to an exhaust pump, the method includes the steps of: 1) installing a filter between the booth and exhaust pump; 2) determining the initial pressure drop across a filter prior to use of the spray booth; 3) determining the maximum allowable pressure drop for the filter prior to the requirement that spraying activities must be terminated by adding the initial pressure drop of the filter to the maximum allowable increase in pressure drop across the filter before the of spraying activities must be terminated; 4) providing a warning when a first portion of the maximum allowable pressure drop is reached; and 5) preventing the use of the spray gun when a second portion, greater than the first portion, of the maximum allowable pressure drop is reached.

6 Claims, 6 Drawing Sheets

FIG. 1
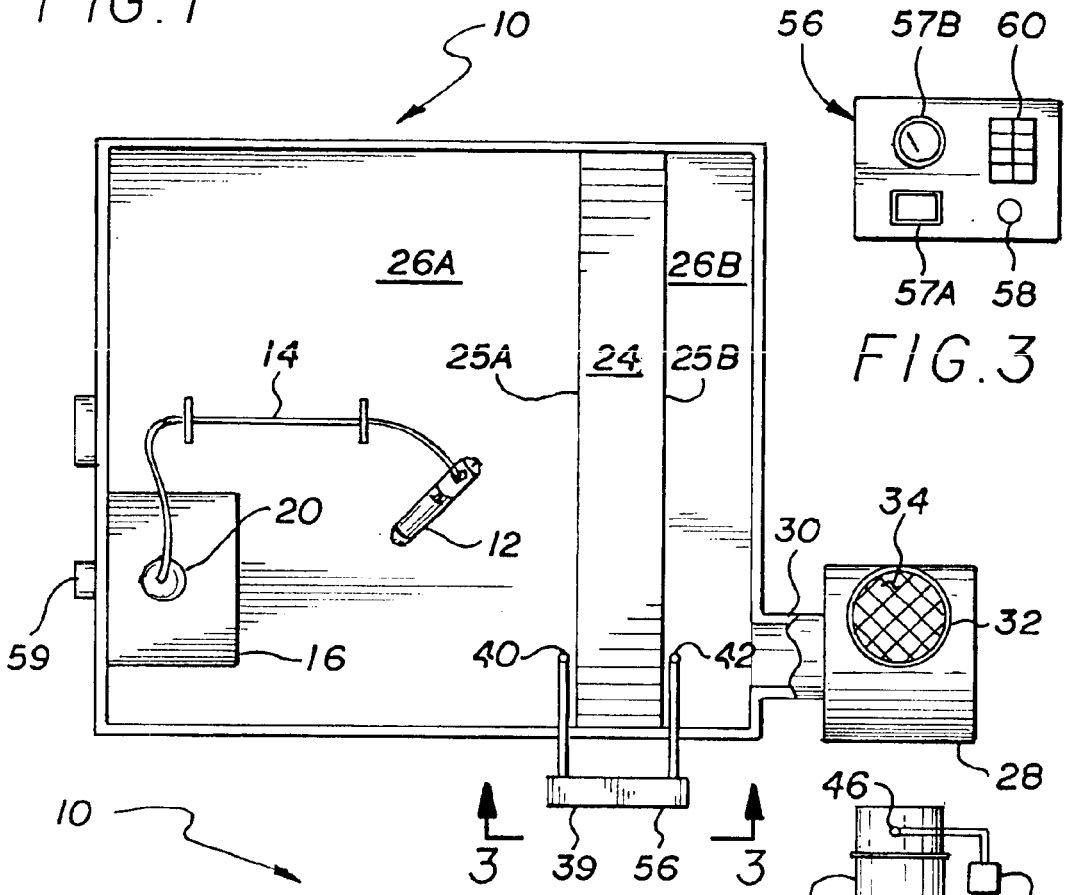
FIG. 3
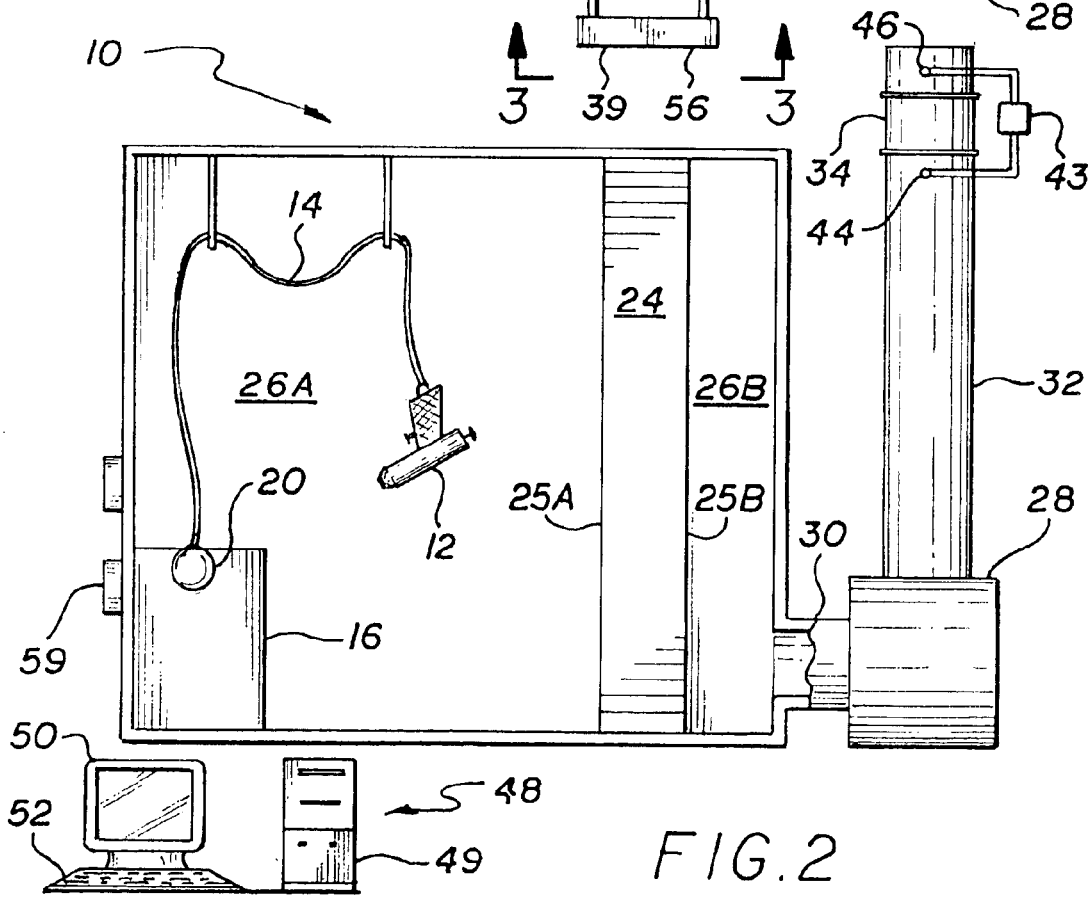
FIG. 2

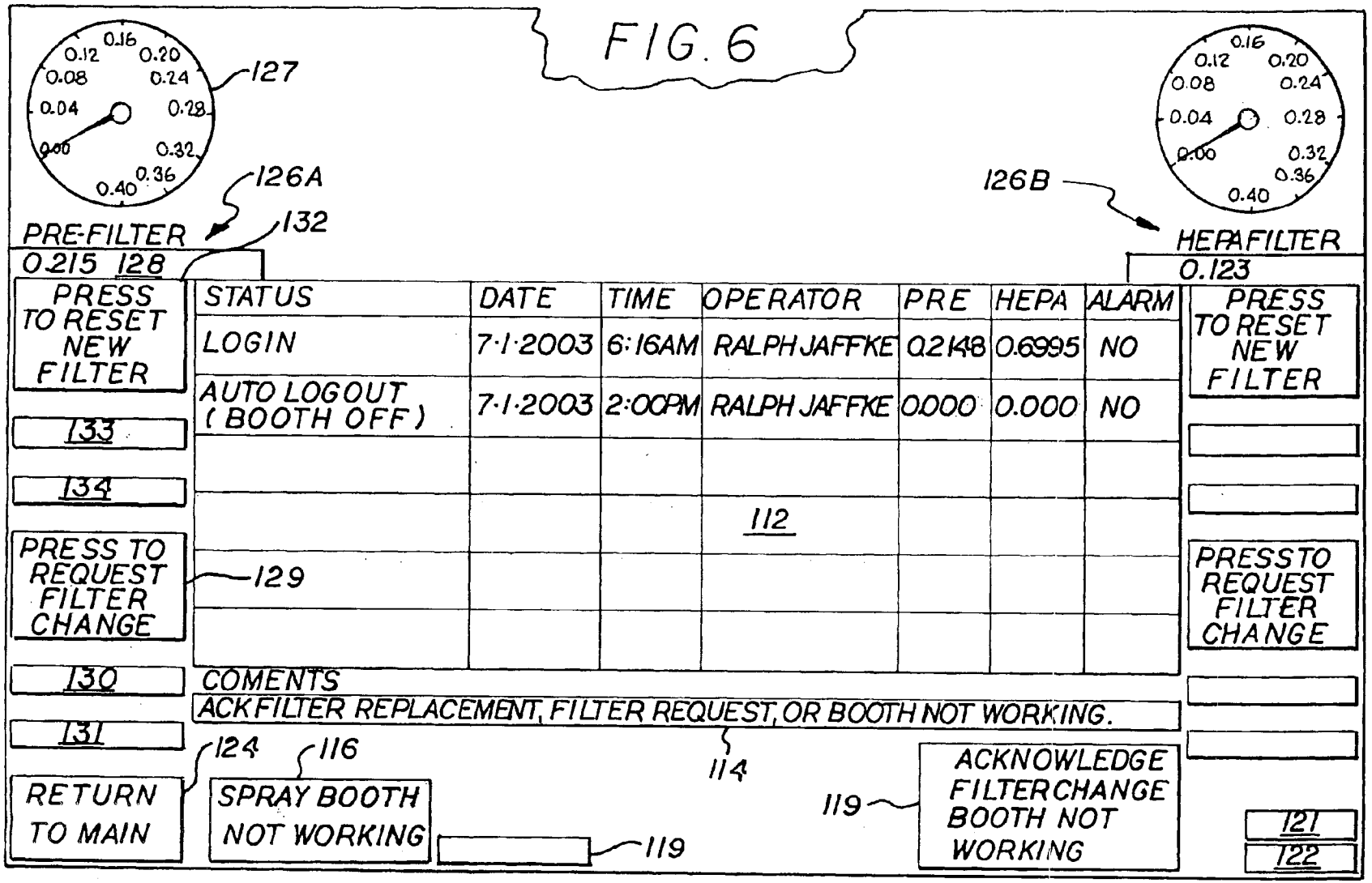
FIG. 6
PRE-FILTER
0.215
128
PRESS TO RESET NEW FILTER
133
134
PRESS TO REQUEST FILTER CHANGE
130
131
RETURN TO MAIN
STATUS
LOGIN
AUTO LOGOUT (BOOTH OFF)
DATE
7·1·2003
7·1·2003
TIME
6:16AM
2:00PM
OPERATOR
RALPH JAFFKE
RALPH JAFFKE
PRE
0.2148
0.000
HEPA
0.6995
0.000
ALARM
NO
NO
COMENTS
ACK FILTER REPLACEMENT, FILTER REQUEST, OR BOOTH NOT WORKING.
SPRAY BOOTH NOT WORKING
HEPA FILTER
0.123
PRESS TO RESET NEW FILTER
PRESS TO REQUEST FILTER CHANGE
ACKNOWLEDGE FILTER CHANGE BOOTH NOT WORKING
112
114
116
119
119
121
122
124
126A
126B
127
132

METHOD OF MONITORING A FILTER SYSTEM FOR A PAINT SPRAY BOOTH

BACKGROUND OF THE INVENTION

1. Field of the Invention

The invention relates to the field of paint spray booths and, in particular, to a filter monitoring system for the spray booth that insures that the maximum available filter life is obtained.

2. Description of Related Art

Environmental regulatory agencies requires self-disclosure of violations to the appropriate Government Agency. Heavy fines are applied to companies that fail to meet the clean air standards. Under this law, paint spray booths equipped with filter systems are closely monitored to prevent over spray from reaching the atmosphere. In addition, the operator within the booth must be protected. Thus spray booth monitoring systems are available that provide alarm signals when the filter(s) is near the end of its useful life.

For example, in U.S. Pat. No. 5,356,334 "Apparatus And Method For Airborne Particulate Booth" by R. D. Gray uses sensors to monitor the pressure drop across filters. A signal is provided when the filters are near the end of their useful life. The apparatus is primarily designed for use in powder type spray operations. Therefore, it uses a filter pulsing system to periodically unclog the filter(s). When the pulse rate becomes almost constant, the alarm signal is activated. The system also provides for signaling when the end of filter life is approaching and shutting down the system should the filter become clogged to a point that it is ineffective. However, it is not desirable to completely shut down the spray booth. There may be a considerable amount of particulate matter still in the spray booth.

Another example can be found in U.S. Pat. No. 5,554,416 "Automated Air Filtration And Drying System For Water-borne Paint And Industrial Coatings" by F. G. Scheufler, et al. Pressure sensors upstream and downstream of the main filter are used to monitor pressure drop across the filter. As the pressure drop increases, signaling filter loading, a signal is sent to a blower to increase the flow rate to compensate therefore. A series of lights illuminate as the blower speed increases indicating filter condition. Thus adequate warning is provided to the operator to turn off the spray booth prior to complete filter failure. However, such a system depends upon the alertness of the operator to shut down the spray booth. Thus there is always a possibility that of operator error. In addition, the Scheufler, et al. system does not compensate for initial filter condition.

Another example can be found in Published Patent Application No.: US 2002/0062788 Al "Apparatus And Method For Configuring Spray Coating Application Systems" by D. M. Czech, et al. Here a system to remotely monitor the performance of a spray-coating booth via the Internet and the like, however, no specific mention of filter monitoring is made.

U.S. Pat. No. 6,168,646 "Flow Rate Control Of Temperature Controlled Fluids" by W. L. Craig, et al. discloses the use a filter assembly including a first roller of fresh filter material and a take up roller. The filter is disposed across the airflow path. As the exposed portion of the filter becomes clogged, the pressure drop there across causes the exposed portion of the filter to distort. This causes the exposed portion of the filter to make contact with a switch, which activates the rollers causing the take up roller to pull unexposed filter material off the first roller across the flow path and winding up the clogged portion on the take up roller. However, no warning device is provided for indicating that the last portion of the filter is clogged.

U.S. Pat. No. 6,040,777 "Device And Process For Indicating The Exhaustion Of A Fan Filter" by K. Ammann, et al. also discloses a device for determining filter life. However, the filter is designed to remove gases from the air. A gas detection device measures the level of the gas and if it rises to a predetermined level, indicating filter saturation, an alarm signal is provided.

Thus it is well-established practice to monitor filter performance in a paint spray booth and the like. However, none of the prior art discloses a system that takes into account the initial pressure drop across a new filter may very from filter to filter. For example consider a filter where the end of useful life occurs when the pressure drop increase across the filter is 3 PSI. If the initial pressure drop reading is 0.5 PSI, then a significant portion of the filter life is lost. Furthermore, none of the prior art devices constantly monitors the pressure drop across the filter, so that any unusual increases or decreases that indicate a problem in the spray booth can be investigated. None of the prior art devices address the problem of particulate matter that maybe still in the air after the spray booth has been shut down.

Thus, it is a primary object of the invention to provide a filter monitoring system for a spray painting booth.

It is another primary object of the invention to provide a filter monitoring system for a spray painting booth incorporating a system to indicated filter status.

It is a further object of the invention to provide a filter monitoring system for a spray-painting booth that provides automatic shut off of the operation of the spray gun at a predetermined percentage of the filter life.

It is a still further object of the invention to provide a filter monitoring system for a spray painting booth that takes into account the initial pressure drop across the filter prior to establishing the expected life of the filter.

It is another object of the invention to provide a filter monitoring system for a spray painting booth that provides a warning if there is a discrepancy between the reading at the end of one paint spraying shift and the beginning of another.

SUMMARY OF THE INVENTION

A typical paint spray booth comprises a closed off room having a bank of primary filters at one end. A blower assembly is in communication with the filters and draws air from the room through the primary filters. The output from the blower is coupled to one or more secondary filters. Thus with an operator spraying parts within the room by means of an air powered type spray gun, excess paint particles are collected on to the primary filters and vapors and smaller particles are collected on the secondary filters.

The invention is a method of monitoring a filter (either the primary or secondary filters or both) for absorbing paint particles or vapors produced during spray painting with a spray gun in a paint spray booth coupled to an exhaust pump. The method comprising the steps of:

1. Installing a filter between the booth and exhaust pump.
2. Determining the initial pressure drop across a filter prior to use of the spray booth. This is accomplished with the use on pressure sensors on either side of the filters.
3. Determining the maximum allowable pressure drop for the filter prior to the requirement that spraying activities must be terminated by adding the initial pressure drop of the filter to the maximum allowable increase in pressure drop across the filter before the spraying activities must be terminated.

4. Providing a warning when a first portion of the maximum allowable pressure drop is reached; and
5. Preventing the use of the spray gun, while keeping the blower in operation when a second portion, greater than the first portion, of the maximum allowable pressure drop is reached.

Preferably, the spray gun is pneumatically (air) powered by pressurized air via a line. A solenoid valve is mounted therein for controlling the airflow there through coupled to the spray gun. Thus the step of preventing the use of the spray gun, while keeping the blower in operation, when a second portion, greater than the first portion, of the maximum allowable pressure drop is reached, includes the step of actuating the solenoid valve to the closed position cutting off airflow to the spray gun.

The first portion of the filter life is about 80 percent of the maximum allowable pressure drop, but can be adjusted depending on operation's requirements. The second portion is 90 percent of the allowable pressure drop, but can adjusted depending on the operation's requirements. It is preferred that the pressure transducers be connected to a computer with a display terminal. Thus the method further includes the step of monitoring the pressure drop across the filter on the display terminal. In addition, method also includes the step of sending an alarm signal to the computer and displaying the alarm signal on the display terminal.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 1 is a top view of a typical paint spray booth

FIG. 2 is a side view of the paint spray booth illustrated in FIG. 1

FIG. 3 front view of a panel attached to an outer wall of the spray booth shown in FIG. 2 taken along the arrow 3.

FIG. 6 is a typical computer screen for changing a filter.

DESCRIPTION OF THE PREFERRED EMBODIMENT

Figure 4A:
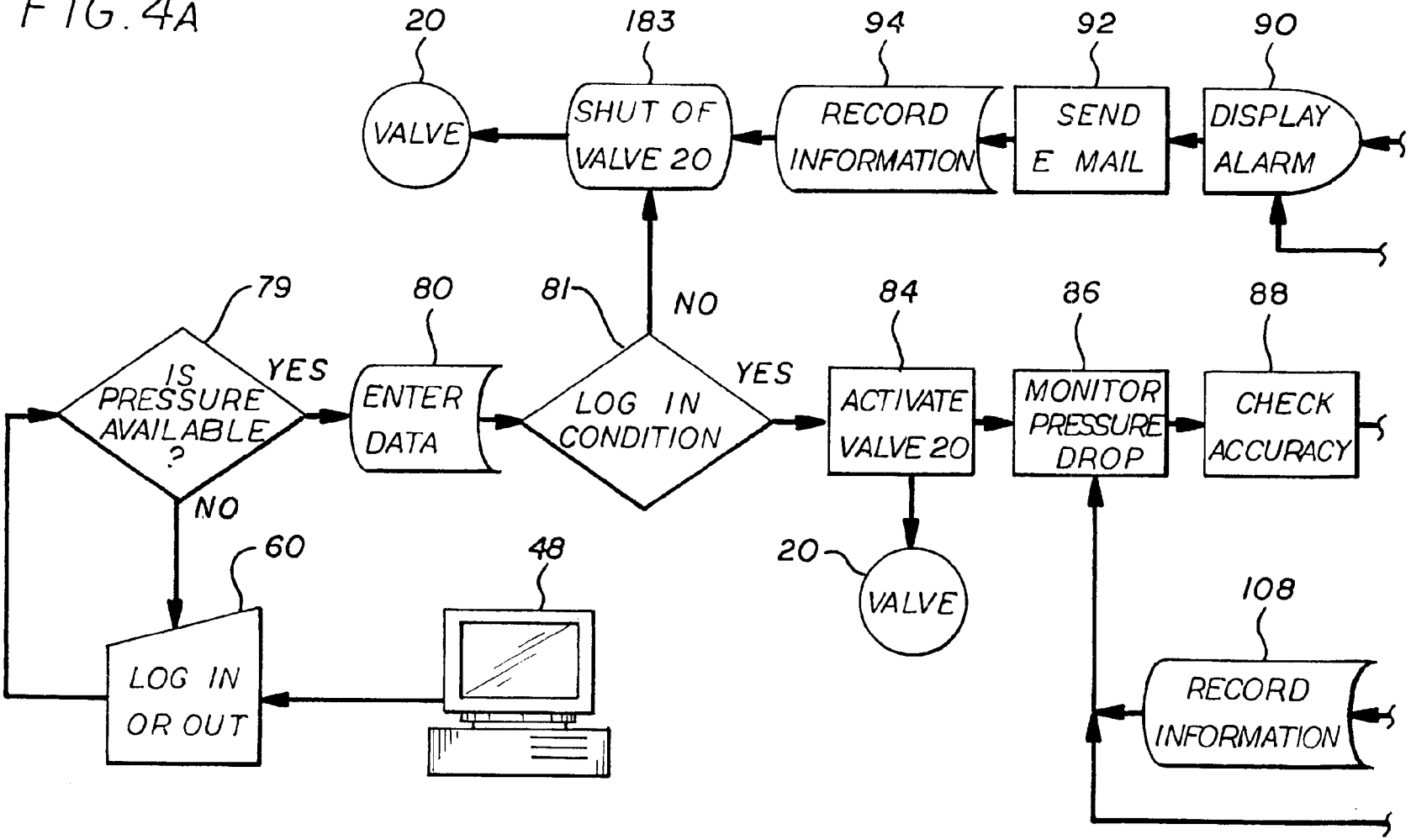
FIG. 4 is a flow chart of the computer program for monitoring spray booth filters.

Referring to FIGS. 1 and 2, the spray booth, generally indicated by numeral 10, includes an air powered spray gun 12 coupled to a line 14, which in turn is connected to a paint spraying apparatus 16. The apparatus 16 includes a normally closed valve 20 that controls the flow of air to the spray gun 12. It should be noted that, while a pneumatically powered spray gun is illustrated, any spraying system could be used in the booth 10. Mounted at end 22 of the booth 10 is a bank of primary filters 24, having first sides 25A and second sides 25B, designed to absorb particulate matter. The filters 24 divide the booth into a spraying area 26A and small chamber 26B. A blower 28 having and inlet duct 30 connected to the chamber 26B and an exhaust duct 32 coupled to a secondary filter 34. The secondary filter is a High Efficiency Particulate Air Filter (HEPA) that insures that small particulate matter is removed from the air prior to reaching the ambient. Thus during paint spraying operations the blower 28 draws the particulate matter through primary filters 24 and pumps the remaining small_particulate matter laden air through the secondary filter 34. Such paint spray booths are in wide use throughout most industries. It is critical that a filter monitoring system be incorporated in order to meet Government mandated personnel safety and air quality requirements. The failure to do so can and will result in large fines and or criminal prosecution.

The filter monitoring system includes a manometer device 39 having pick up ports 40 and 42 positioned on each side 25A and 25B of the filter 24 and a second manometer device 43 having pickup ports 44 and 46 on each side of the filter 34. The manometers 39 and 43, as well as valve 20 are connected to a remotely located computer assembly 48 having a computer 49 display terminal 50 and keyboard 52. Referring to FIG. 3, the manometer 40 includes a panel 56 having digital gage 57A and analog gage 57B. The panel 56 further includes a switch 58 for manually controlling valve 20. In addition, a keypad 60 is provided to prevent unauthorized use. Thus should the computer system, to be subsequently discussed, fail, the valve 20 can be manually controlled. The blower 28-control panel (including on/off switch) is indicated by numeral 59.

Figure 4B:
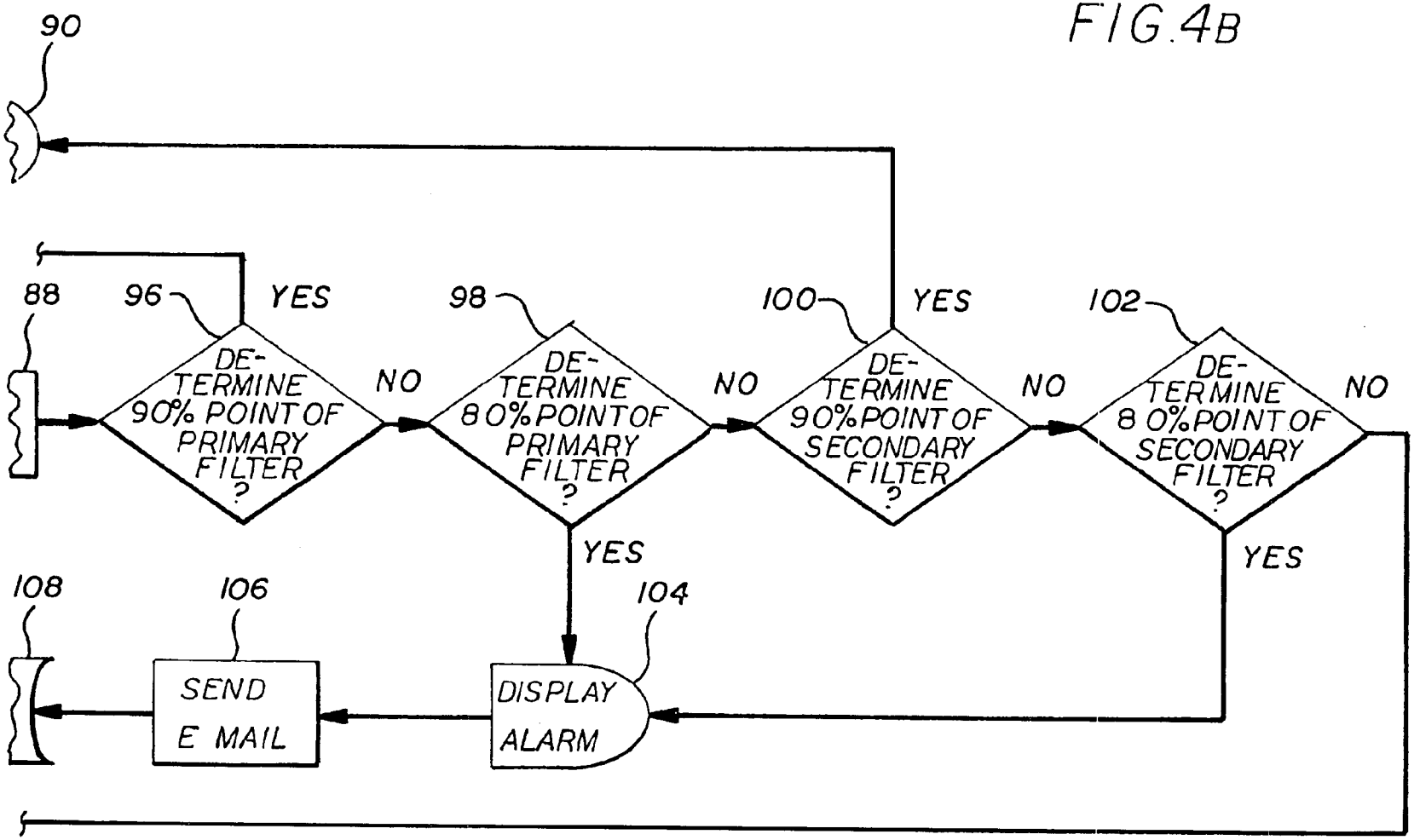
Figure 5:
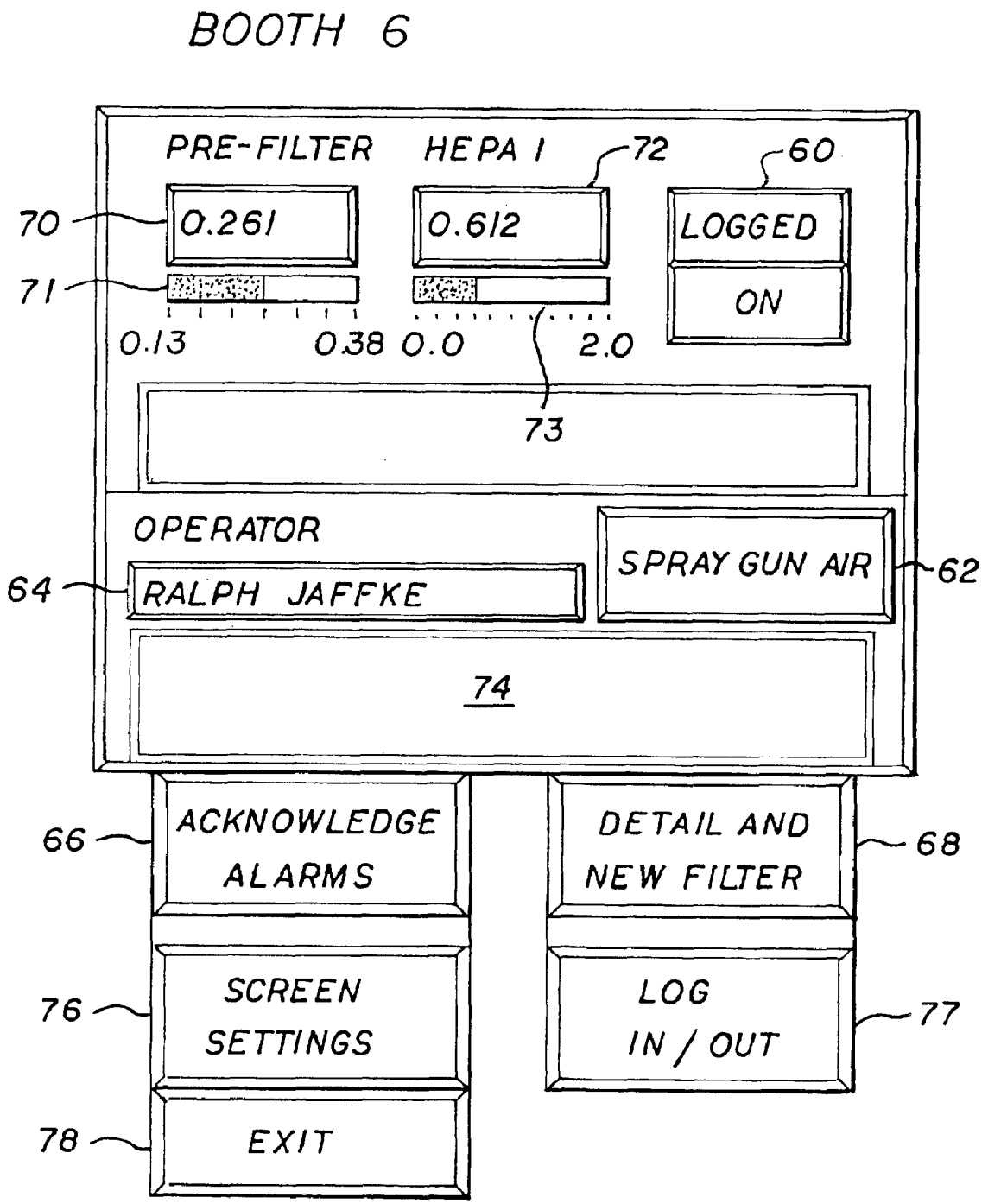
FIG. 5 is a typical computer screen for monitoring filter performance.

FIG. 4 is a Process Flow Chart for the computer program to monitor filter performance. It comprises the following steps:

Step 60 Log in or out—The operator swipes their identification card or manually enters the data. When the operator logs on, the screen as depicted in FIG. 5 appears on the terminal screen. The screen includes the following displays:

Logged On and Off Indicator Light 60
Spray gun Air Condition Light (valve 20 open or closed) 62
Operator Name Window 64
Acknowledge Alarms Button 66 (Touch Screen Indicator)
Details and New Filter 68 (transfers to FIG. 6 screen) which will be
subsequently discussed. Also a touch screen indicator.
Primary Filter Digital Read Out 70
Primary Filter Gauge 71
Secondary Filter Digital Read Out 72
Secondary Filter Gauge 73
Message Screen 74
Screen Setting Button 76
Log IN/OUT Button 77
Exit Program Button 78.

Step 79 Determination Of Pressure Drops. If there is no pressure drop, the blower 28 is not running. Then the system automatically goes back to step 60. If pressure drops are sensed, then to Step 80.

Step 80 Enter Data—Time, Operator name and ID are recorded as well as an initial pressure drop reading across filters 24 and 34.

Step 81 Determination If Operator Logging On Or Off—The existing pressure drop across the primary and secondary filters, is determined and recorded. If there is no pressure drop, then to step 83. If there is a pressure drop, then to Step 84.

Step 83 Shut Off Valve 20—If Valve 20 is open, a signal is sent to the valve causing it to shut down cutting off air pressure to spray gun 12.

Step 84 Activate Solenoid Valve 20—A signal is sent to the valve 20 causing it to open and allow operation of the spray gun 12.

Step 86 Monitor Pressure Drops—The program continues to monitor the pressure drops across the primary and secondary filters, 24 and 34. These pressure drops are indicated on the Screen in FIG. 4.

Step 88 Check Accuracy—The pressure drop determination across the primary and secondary filters 24 and 34 is compared to last reading made. If there is a significant change, a warning is provided in the message screen 74 in FIG. 5. If no error is detected, then to Step 96. For example, one of the filters could have had a structural failure or have blown out. This would result in a significant change in pressure drop readings.

Step 90 Display Alarm—An error signal is generated causing a "ALARM CONDITION" message to appear at the message screen 78 (FIG. 4).

Step 92 Send E-mail—Email notifications are sent to all effected departments.

Step 94 Record Information—Automatically back to Step 83 Shut off Valve 20. As previously stated, that if there is not significant change recorded in the Step 88 Check Accuracy, Step 96 follows.

Step 96 Determine 90 Percent Point Of Primary Filter—The actual pressure drop across the primary filter 24 is compared to the point where the filter is completely filled and if the 90 percent point is reached then to Step 90. If not, to step 98. Note that the level at which the can be adjusted upward or downward.

Step 98 Determine 80 Percent Point Of Primary Filter—The actual pressure drop across the primary filter 24 is compared to the point where the filter is completely filled and if the 80 percent point is reached then to Step 106, which will be subsequently discussed. The 80 percent warning can also be adjusted upward or downward.

Step 100 Determine 90 Percent Point Of Secondary Filter—The actual pressure drop across the secondary filter 34 is compared to the point where the filter is completely filled and if the 90 percent point is reached then to Step 90. If not, to step 102.

Step 102 Determine 80 Percent Point Of Secondary Filter—The actual pressure drop across the secondary filter is compared to the point where the filter is completely filled and if the 80 percent point is reached then to Step 106. If not, return to Step 86.

Step 104 Display Alarm—A signal is generated causing a "80 PERCENT FILTER READING" message to appear at the message screen 78 (FIG. 4).

Step 106 Send E-mail notification to all effected departments.

Step 108 Record Information—Return to Step 86 to continue monitoring.

Referring to FIGS. 1–6, when either the primary or secondary filters need to be replaced, the blower 28 of course is turned off at panel 59. The filter is replaced. The operator then restarts the blower 28 and presses the screen at the "Detail and New Filter" button on the screen in FIG. 5. This brings up the screen illustrated in FIG. 6. This screen includes a time history section 112, were the actions taken by operators are recorded. A comments section 114 where the operator can enter actions taken, etc. There is also a spray booth not working light 116 and an initiated by space 117 and date space 119. In addition there is a spray booth not working acknowledgment button 120. Additionally date and time windows 121 and 122 indicated the day and time. There is also a return to main menu button 124, which returns the operator back to the screen in FIG. 5. Thus a record of the spray booth down time is maintained.

Of most importance in the screen in FIG. 6 are the filter change control panels 126A and 126B. The control panel 126A includes a dial gauge 127, and digital gauge 128. A press to request filter change button 129, with date and time windows 130 and 131 is also provided. Thus maintenance personnel will be contacted to replace the filter. However, in some cases the filter will already have been change. Assuming that the new filter is installed the press to reset new filter button 132 is pressed and date and time windows 134 and 135 will automatically record the time and date. This will automatically reset the gauges 71 and 72 in the screen in FIG. 5. The Control panel 126B operates in a similar manner and thus will not be further discussed.

Figure 7:
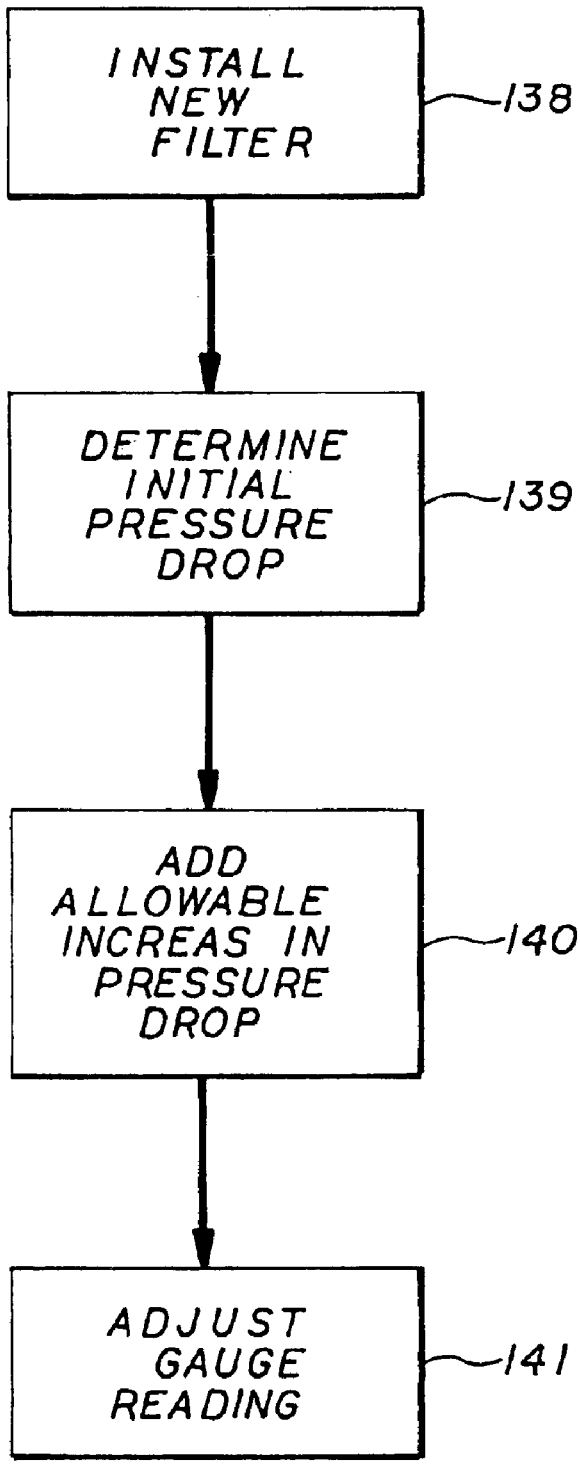
FIG. 7 is a flow chart of the portion of the computer program for calculating the useful life of the filter.

When the operator presses button 132 press to reset filter, the program as illustrated in FIG. 7 will automatically add the allowable pressure drop increase for the filter to the initial reading. This then becomes the starting point for the primary or secondary filter digital read out gages 70 and 74 and gages 72 and 76, as the case may be shown in FIG. 5. Thus referring to FIG. 7 the steps are as follows:

Step 138 Install new filter—This requires that the old filters be removed and replaced with new ones.

Step 139 Determine Initial Pressure Drop—The blower 28 is turned on and readings are recorded.

Step 140 Add Allowable Pressure Drop Increase—This is the amount of pressure drop increase for the filter before it is considered ineffective.

Step 141 Adjust Gage Readings—The Initial pressure Drop and Allowable Pressure Drop Increase are added together to provide a Total Pressure Drop. This value is then used in determine the 80 percent and 90 percent values.

Thus it can be seen that the monitoring system compensates for the variation in initial pressure drop across the filter, increasing the useful filter life, provides a warning if an unusual pressure drop change occurs. Finally, only the spray gun is turned off, when filter limits have been reached and the blower will continue to operate insuring that and remaining paint particles or vapors are collected.

While the invention has been described with reference to a particular embodiment, it should be understood that the embodiment is merely illustrative, as there are numerous variations and modifications, which may be made by those skilled in the art. Thus, the invention is to be construed as being limited only by the spirit and scope of the appended claims.

INDUSTRIAL APPLICABILITY

The invention has applicability to the paint and coating application industry.

What is claimed is:

1. A method of monitoring a filter for absorbing paint particles produced during spray painting with a spray gun in a paint spray booth coupled to an exhaust pump, said method comprising the steps of:

installing a filter between the booth and exhaust pump;

determining the initial pressure drop across a filter prior to use of the spray booth;

determining the maximum allowable pressure drop for the filter prior to the requirement that spraying activities must be terminated by adding the initial pressure drop of the filter to the maximum allowable increase in pressure drop across the filter before the of spraying activities must be terminated;

providing a warning when a first portion of the maximum allowable pressure drop is reached; and preventing the use of the spray gun when a second portion, greater than the first portion, of the maximum allowable pressure drop is reached.

2. The method as set forth in claim 1 wherein the spray gun is pneumatically powered by pressurized air via a line having a solenoid valve mounted therein for controlling the airflow there through coupled to the spray gun, said step preventing the use of the spray gun when a second portion, greater than the first portion, of the maximum allowable pressure drop is reached includes the step of actuating the solenoid valve to the closed position cutting off airflow to the spray gun.

3. The method as set forth in claim 2 wherein the pressure drop is measured by means of first and second pressure sensors positioned on either side of the filter.

4. The method as set forth in claim 3 wherein the first portion is 80 percent of the maximum allowable pressure drop and the second portion is 90 percent of the allowable pressure drop.

5. The method as set forth in claim 4 wherein the pressure transducers are connected to a computer with a display terminal, the method including the step of monitoring the pressure drop across the filter on the display terminal.

6. The method as set forth in claim 5 including the step of sending an alarm signal to the computer and displaying the alarm signal on the display terminal.

* * * * *